US005104192A

United States Patent [19]

Gianfranchi

[11] Patent Number: 5,104,192

[45] Date of Patent: Apr. 14, 1992

[54] STRUCTURE FOR CHAIRS, SMALL ARMCHAIRS AND THE LIKE WITH MEANS FOR COMPLETION IN DIVERSIFIABLE VERSIONS

[76] Inventor: Pier L. Gianfranchi, Via G. Luosi, 5, 20131 Milano, Italy

[21] Appl. No.: 641,708

[22] Filed: Jan. 15, 1991

[30] Foreign Application Priority Data

Jan. 23, 1990 [IT] Italy ..... 19130 A/90

[51] Int. Cl.[5] ..... A47C 7/00

[52] U.S. Cl. ..... 297/445; 297/443; 403/368; 403/374

[58] Field of Search ..... 297/440, 443; 403/368, 403/374, 377

[56] References Cited

U.S. PATENT DOCUMENTS

| | | | |
|---|---|---|---|
| 170,236 | 11/1875 | Coleman | 403/368 |
| 2,542,967 | 2/1951 | Waechter | 403/368 X |
| 3,245,715 | 4/1966 | Gits | 297/440 X |
| 3,266,843 | 8/1966 | Feder | 297/440 |
| 3,849,015 | 11/1974 | Peter et al. | 403/368 X |
| 4,216,995 | 8/1980 | Inaba | 297/443 |

FOREIGN PATENT DOCUMENTS

| | | | |
|---|---|---|---|
| 70263 | 11/1958 | France | 297/443 |
| 1253296 | 1/1961 | France | 297/440 |
| 653262 | 2/1963 | Italy | 297/440 |

*Primary Examiner*—Peter A. Aschenbrenner
*Attorney, Agent, or Firm*—Stevens, Davis, Miller & Mosher

[57] ABSTRACT

The present invention relates to a structure for chairs, small armchairs and the like with means for completion in diversifiable versions and which has the peculiarity that it comprises a monobloc bearing body defining a seat and back in a single body.

In the side zones of said seat in the back connection part there is defined a through passing channel in which is incorporable a tube which constitutes the attaching element of means embodying the supporting frame of the seat, small arm chair and the like.

In said tube are insertable inserts for locking the above mentioned means which embody the supporting frame.

19 Claims, 4 Drawing Sheets 28
25
23
20
21
26
27

20
21
23
28
10
13
2
14
27
23
20
21
11
25
25
7
6
7
13
10
11
27
27
20
40
28
23
25

STRUCTURE FOR CHAIRS, SMALL ARMCHAIRS AND THE LIKE WITH MEANS FOR COMPLETION IN DIVERSIFIABLE VERSIONS

The present invention relates to a structure for chairs, small armchairs and the like with means for completion in diversifiable versions.

As is known, there are already present on the market chairs, small armchairs and the like which have a body defining the back and seat with so-called "bearing" characteristics. For these kinds of embodiments it is usually necessary to make a supporting frame or structure which in practice acts as an element of containment of said body, i.e. the body is supported mechanically by the supporting frame, while there are no known solutions in which it is the body itself which in practice functions as the structural node for connection of what will later be the supporting frame.

Another problem encountered with the solutions of the known art consists of the fact that, having to make chairs, small armchairs and the like in various versions, such as for example with legs for floor support, with central pedestal, or with connection to a bar to provide a row of chairs or small armchairs, it is necessary in practice to considerably diversify production either of the means of mutual connection or also of the body which must be then connected to said support means.

From the foregoing it follows that it is not presently possible in practice to standardize the making of chairs and armchairs, making a body which could subsequently be used for all forms of embodiment expected.

As is clear, this fact brings considerable constructive diversifications with the unavoidable connected cost increases.

The proposed purpose of the invention is to eliminate the shortcomings previously complained of by providing a structure for chairs, small armchairs and the like with means for completion thereof in diversifiable versions, which would make possible the provision of a single type of body which, constituting the bearing element, would then make it possible to be variously appreciated, thus being able to obtain all possible completions without specific structural changes.

Within the framework of the above purpose, one object of the present invention is to provide a chair structure which would allow standardization of the construction phases with the possibility of changing at any time the contingent construction completions.

Another object of the present invention is the provision of a structure for chairs, small armchairs and the like which, subverting the traditional production criteria, would make possible obtaining a very valid structure while capable of resisting even relatively high stresses thanks to the synergic effect obtained by combining a monobloc body of synthetic material with metal fittings.

Another object of the present invention is the provision of a structure for chairs, small armchairs and the like which, due to its peculiar construction characteristics, would be able to give the fullest guarantee of reliability and safety during use.

Not the least object of the present invention is to provide a structure for chairs, small armchairs and the like which would be easy to obtain starting with common elements and materials available in trade which would also be competitive from a purely economic point of view.

The purpose outlined above as well as the objects mentioned and others which will become clear below, are achieved by a structure for chairs, small armchairs and the like with means of completion thereof in diversifiable versions characterized in that it comprises a bearing body defining at least the seat, there being defined in the side zones of said seat a through passing channel in which is incorporated a tube constituting the attaching element of free ends of elements for completion of the structure of the chair, small armchair and the like, said elements comprising a supporting frame for the chair and there being insertable in said tube locking inserts for said ends within the tube.

Further characteristics and advantages will appear more fully from the description of a preferred but not exclusive form of execution of a structure of a chair, small armchair and the like with means for completion thereof in diversifiable versions illustrated in an indicative and nonlimiting manner with the aid of the annexed drawings wherein:

FIG. 1 shows a schematic perspective view of one of the possible forms of the chair, FIG. 2 shows a schematic exploded view of the chair making clear some of the possible means of making the supporting frame, FIG. 3 shows a cross section of the body along line of cut III—III of FIG. 2, FIG. 4 shows and end view of the tube, FIG. 5 shows a section plane and an exploded view of the tube inserted in the body, FIG. 6 shows a cross section of the assembled tube along plane of cut III—III of FIG. 2

Figure 1:
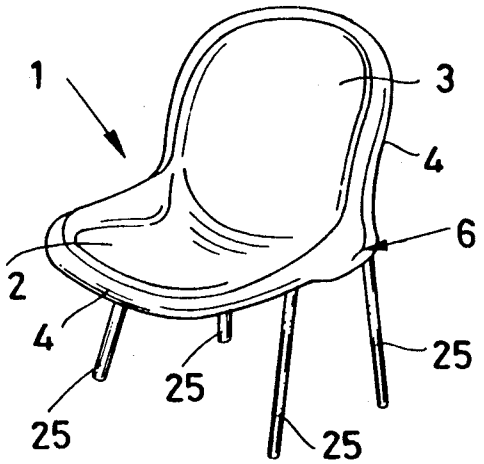

With reference to the figures the structure of a chair, armchair and the like with means for their completion in diversifiable versions in accordance with the invention comprises, as is well seen in FIG. 1, a monobloc bearing body indicated as a whole by reference number 1 and which is advantageously provided of molded synthetic material. Said body 1 defines advantageously in a single body a seat 2 and a back 3 which can have any shape.

Either to obtain mechanical stiffening or a good appearance, there may be provided a turned back edge 4 which involves substantially the entire periphery of the body 1.

Figure 3:
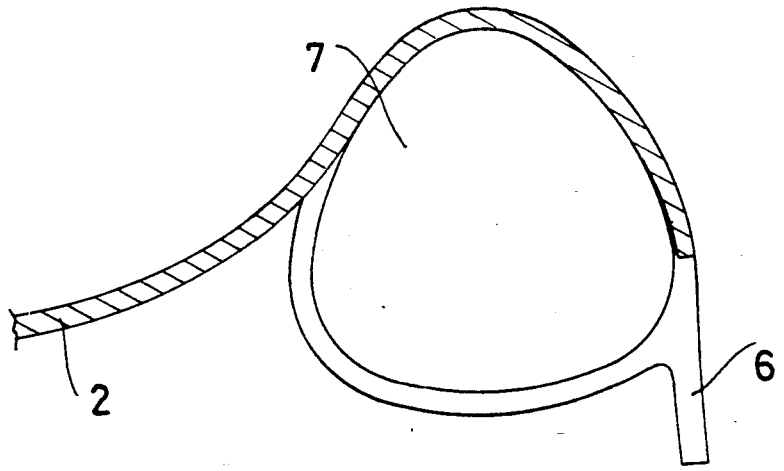

In addition, at the side zones of the seat and near the back connection zone there are defined in practice ears, indicated generally by reference number 6, which delimit with the seat surface a through passing channel 7 (shown clearly in FIG. 3) which has advantageously a substantially polygonal form and develops in a direction substantially parallel to the direction of development of the side edges of the seat.

Figures 5, 7:
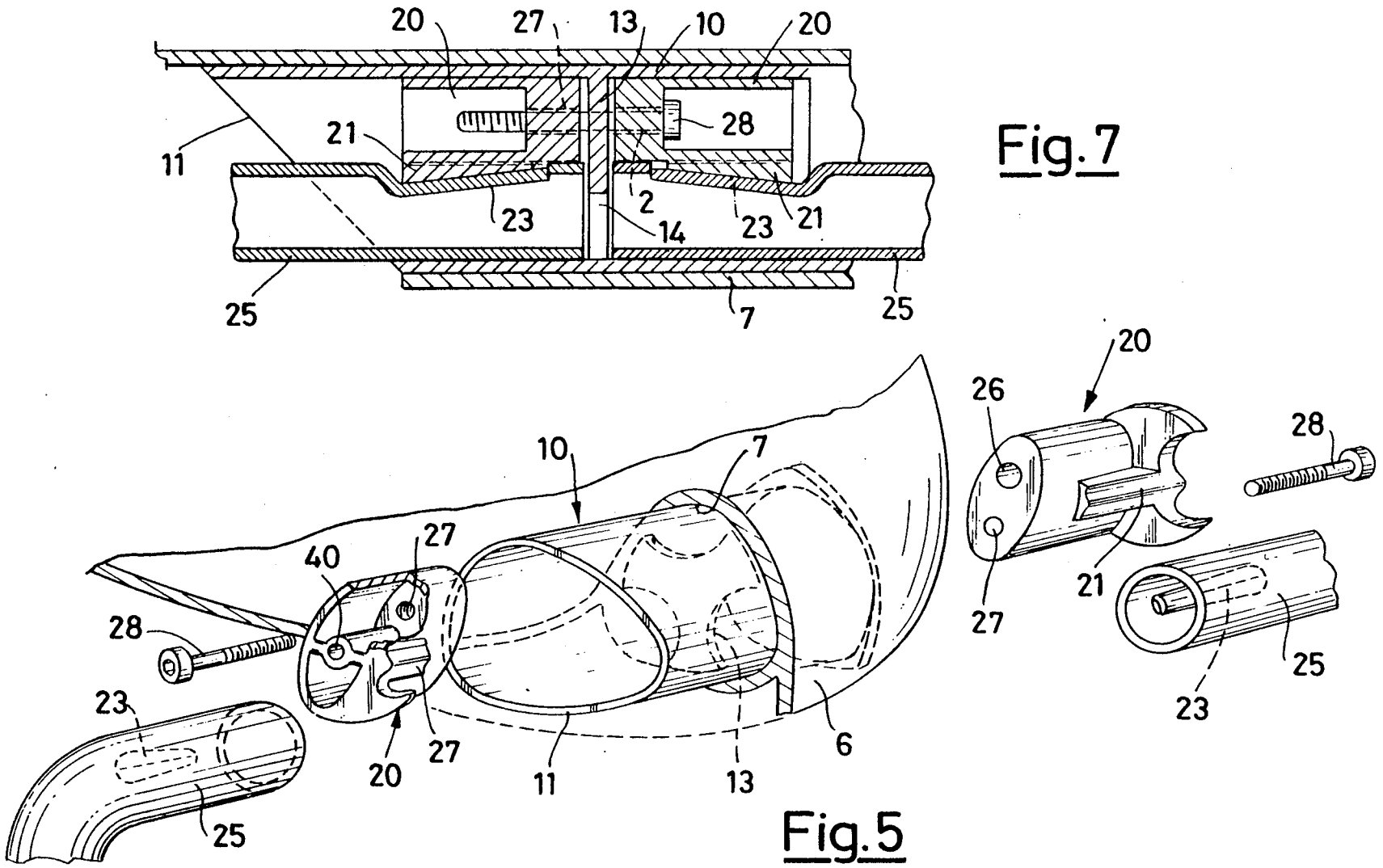
FIG. 7 shows schematically a partial cross section of a possible locking system along plane of cut VII—VII of FIG. 6.

Inside said through passing channel 7 is insertable a tube, as shown for example in FIG. 5, indicated as a whole by reference number 10 and which is incorporable in the body immediately after the molding phase of the body so that it is the shrinking of the material during cooling which performs anchoring of the tube 10 in the channel 7. The tube 10 also has a substantially polygonal form conjugate with the section of the channel 7.

The polygonal section has the function of providing a restraint against rotation of the tube around an axis corresponding to the direction of development.

Figure 4:
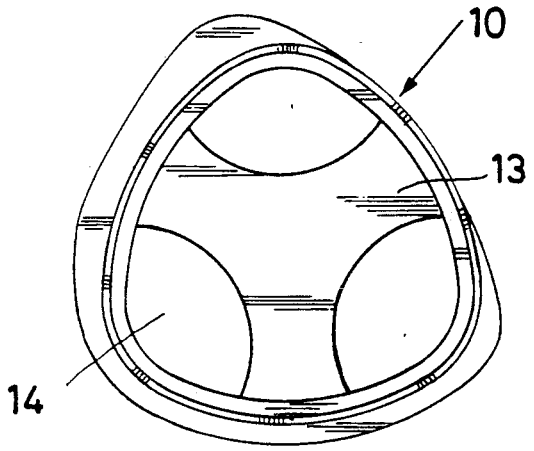

Advantageously, even though not necessarily, the tube 10 has a substantially triangular form with curved sides with outward convexities as is well seen in FIG. 4.

Figure 2:
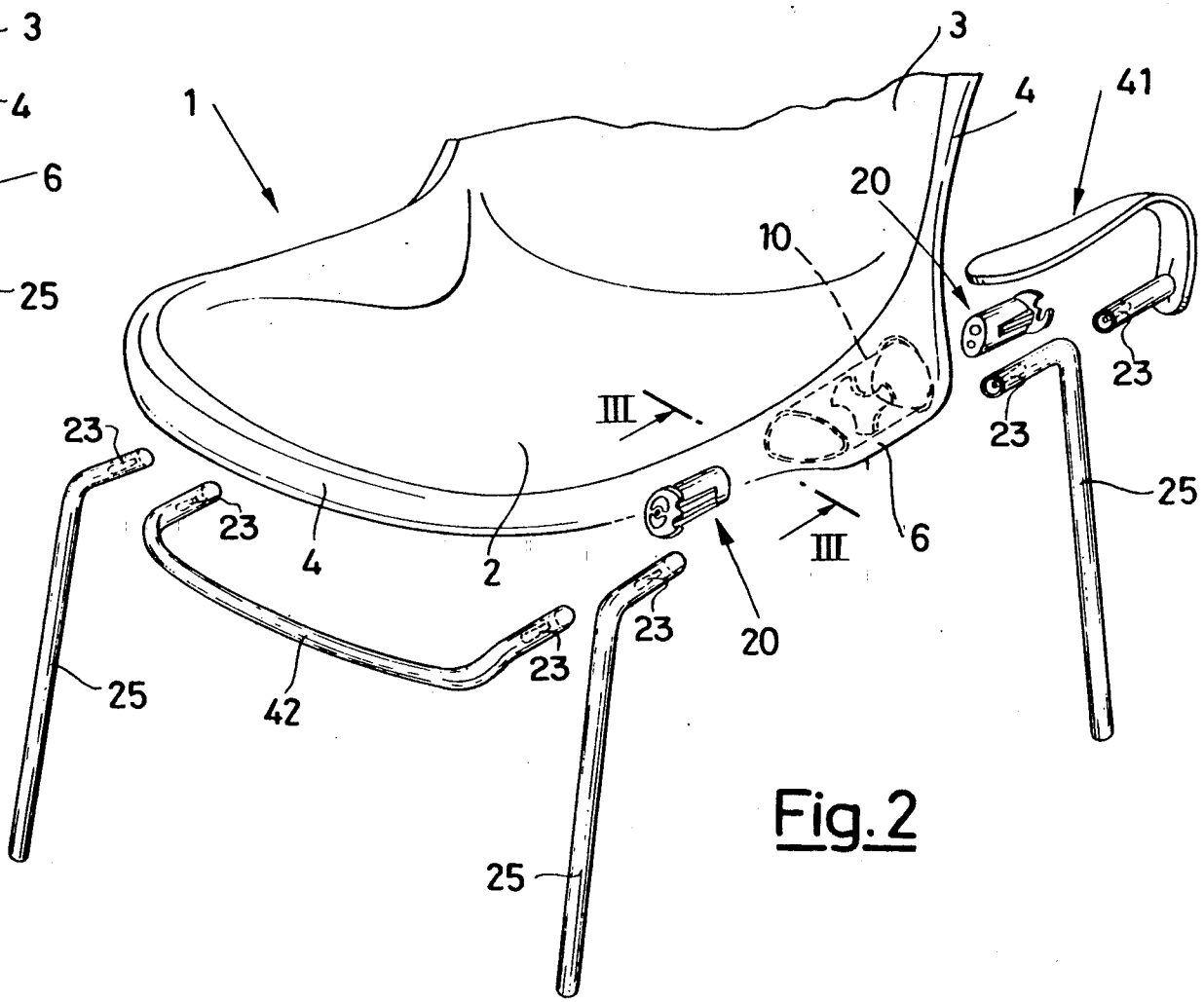

As shown in the FIGS. 2, 5 and 7, at one end, i.e. the front end, the tube 10 has as an inclined cut 11 which is radiused with the line of the edge 4 of the body 1 beneath which there is inserted the tube.

The tube has in its middle portion a dividing diaphragm 13 which defines passage openings 14 the function of which is clarified below.

The important peculiarity of the invention consists of the fact that said tube 10 provides in practice the attaching element for the means which provide the supporting frame of the chair, small armchair and the like because in the tube are insertable inserts which allow clamping of said means in various predeterminable positions.

The inserts are indicated by reference number 20 and have advantageously an oblong shape in transverse cross section with at least one portion conjugated with the internal shape of one side of the tube.

The inserts 20 for obtaining a tapered coupling are equipped on the face opposite that having the form conjugate with the side of the tube a clamping tooth indicated by reference number 21 with thickness increasing from the inside toward the outside which is inserted in corresponding notches 23 defined on the support means which in FIGS. 1 and 2 are indicated schematically by tubular elements 25 which provide the legs but which of course, as clarified below, can be made of different elements for completion of the chair structure.

On this subject it should be noted that by the term "frame" it is intended to indicate, in addition to floor support elements for the body, all other accessorial elements of the chair structure such as for example the arms or other elements projecting from the body. Advantageously, inserts and tube are provided with a slight taper, as shown schematically in FIG. 7.

At the internal end the inserts 20 have preferably a through passing hole 26 and a threaded hole 27 in which are engaged in passage and in tightening threaded tie-rods 28 which interact between two inserts arranged in an opposing manner in relation to the diaphragm 13 of the tube.

The form of the tube and inserts makes it possible to arrange the inserts in various positions inside the tube depending on the type of means which provide the frame. Indeed, as shown schematically in FIG. 2, the frame means can consist of legs 25, an element 42 for connection to a supporting bar of the known art and therefore not shown, or any other structural or accessorial element it may be desired to use, including arms 41, boards or the like, as is clarified below. Said elements thus will call for one end with a notch similar to the notch 23 in the legs 25 and will be engaged in one of the seats offered by the sleeves.

If the support means occupy all four of the inserts as shown for example in FIG. 1 or even if merely preferred, the connection of additional accessorial elements can take place using a seat 40, e.g. threaded, on the end of each insert turned outward in the tube.

As an alternative, accessorial elements can be provided integrally with an insert 20, otherwise similar to that shown.

Figure 6:
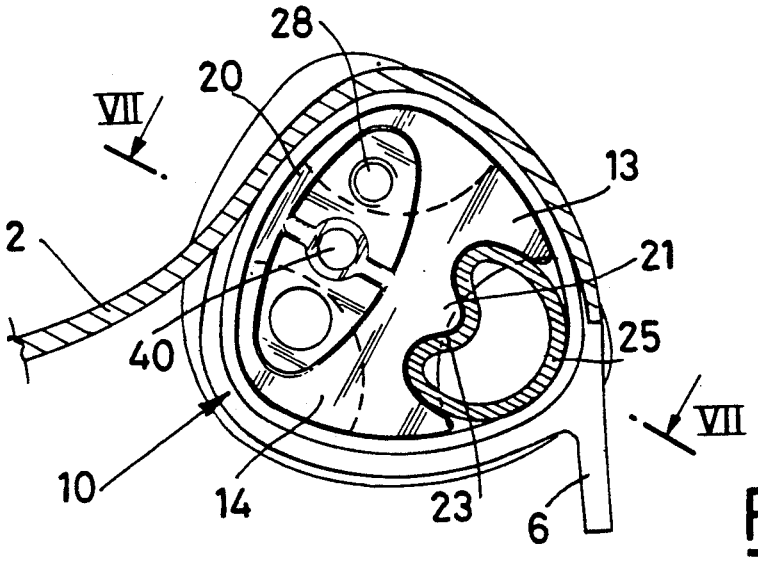

It is pointed out that with the structural coupling described the clamping of the supporting elements, which in practice are connected to the body, takes place, as may well be seen in FIGS. 6 and 7, by mutual tightening of a pair of inserts arranged in an opposing manner and which, due to the presence of the hooking tooth, perform together with the tightening of the means which provide the supporting frame, thus obtaining a double tapered coupling which creates the best tightening conditions.

Engagement of the tooth 21 in the notch 23 prevents rotation of the element 25, which is thus firmly constrained to the seat body.

The polygonal form of the tube, in addition to preventing rotation thereof, as mentioned above, allows obtaining a vast range of connection types because the arrangement of the means providing the supporting frame inside the tube is variable depending on the type of supporting frame it is desired to provide.

To better understand the connection flexibility afforded by the present invention, FIGS. 8 to 11 show various embodiments of chairs using the innovative principles claimed herewith.

Figure 9:
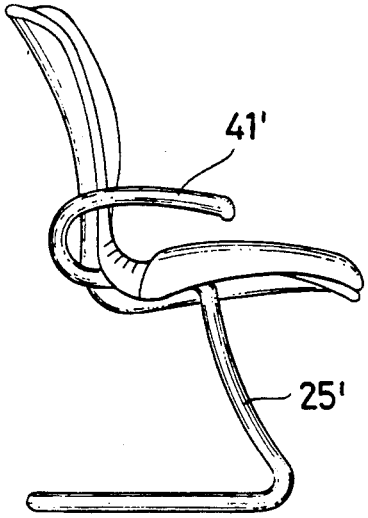
Figure 8:
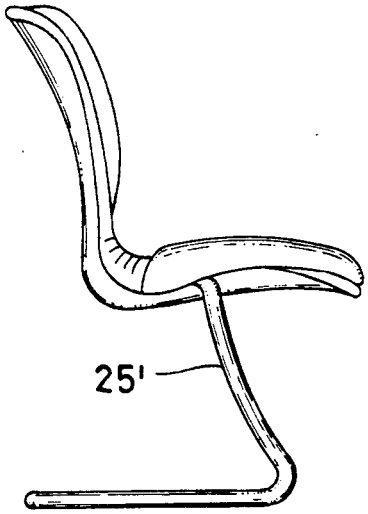

For example, FIG. 8 shows a chair with legs in the form of an L 25' fixed only at the front to the tube. FIG. 9 shows the same chair with added arms 41'. Since the legs only occupy the front part of the tubes, the arms can be advantageously engaged in the rear part with clamping inserts 20 as mentioned above.

Figure 10:
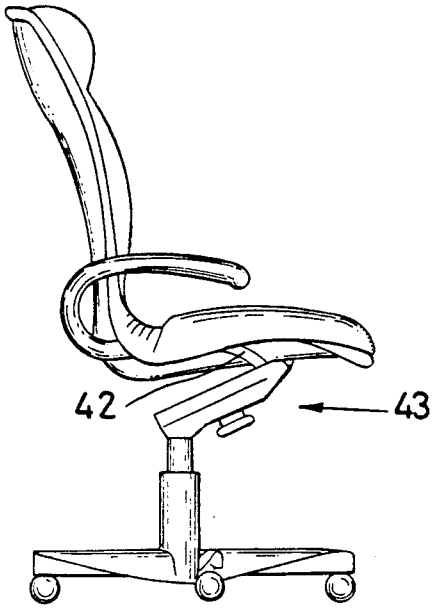
FIGS. 8–11 show side views of different possible seat configurations provided in accordance with the invention.

FIG. 10 shows a small armchair using the bar 42 for fixing to a wheeled base 43.

Figure 11:
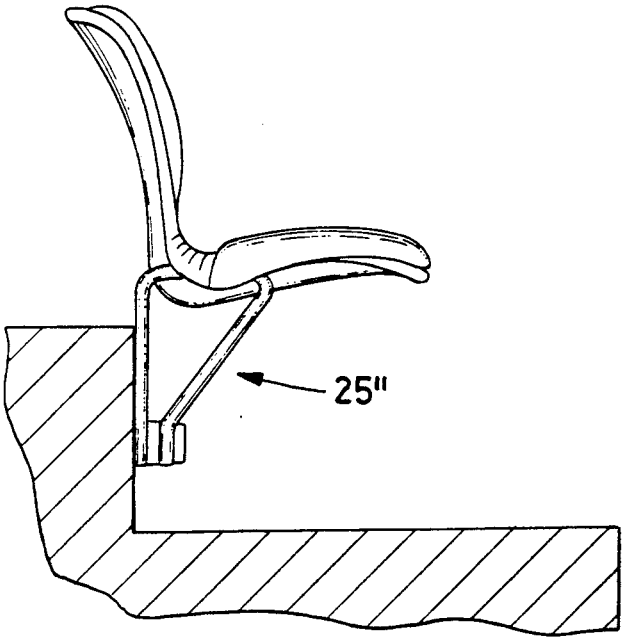

Finally, FIG. 11 shows a chair with supports 25'' for fixing in a stepped architectural structure such as for example a stadium, amphitheatre or the like.

At this point it is clear how by following the innovative embodiment concept described it is possible to combine in various ways that which is shown for example in FIGS. 8–11 and other elements such as supporting boards or other to obtain chairs meeting the most varied requirements.

From the foregoing illustration it is seen how the invention achieves the objects proposed and in particular it is pointed out that there is provided a chair structure in which there is provided a metal tube directly incorporated in the bearing body and which acts as a bearing structural node for connection of the various means of providing the supporting frame, i.e. means which can be varied without thereby modifying in any way the body and the tube.

In addition, provision of clamping by opposed tightening of the inserts with tapered positions which are united by tie-rods which pass through the openings 14 further increases the clamping effect and allows compensation of the stresses generated, discharging them all in the metal tube which is capable of having the desired mechanical strength.

The invention thus conceived is capable of numerous modifications and variations all falling with in the inventive concept.

In addition all the details can be replaced by other, technically equivalent, elements.

In practice the materials used and the contingent dimensions and forms can be of any kind depending on requirements.

I claim:

1. Structure for chairs, small armchairs and the like comprising a bearing body defining at least a seat having underneath side zones, a channel extending through each of said side zones, a tube fixed within each said channel, at least one attaching element having a free end incorporated into said tube and tube clamping inserts within said tube for securing to said bearing body said free ends of said attaching element.

2. The structure for chairs, small armchairs and the like in accordance with claim 1 wherein said attaching elements are legs.

3. The structure for chairs, small armchairs and the like in accordance with claim 1 wherein said side zones are defined by said body having a turned back rear edge and a side ear.

4. The structure for chairs, small armchairs and the like in accordance with claim 1 wherein said through passing channel has in its cross section a substantially polygonal form conjugate with the form of the cross section of said tube.

5. The structure for chairs, small armchairs and the like in accordance with claim 1 wherein said through passing channel and said tube have in their cross section a substantially triangular form and curved sides with convexity toward the outside.

6. The structure for chairs, small armchairs and the like in accordance with claim 1 wherein said tube develops along a direction substantially parallel to the development of the side edge of said seat.

7. The structure for chairs, small armchairs and the like in accordance with claim 3 wherein said tube has its front end inclined in relation to its axis and its back end radiused to join said turned back edge.

8. The structure for chairs, small armchairs and the like in accordance with claim 1 wherein said tube has in a middle portion of the axial development a separating baffle having passage openings.

9. The structure for chairs, small armchairs and the like in accordance with claim 1 wherein said inserts have in cross section an oblong form with at least one surface portion conjugate with the internal form of one side of said tube.

10. The structure for chairs, small armchairs and the like in accordance with claim 9 wherein said inserts have on the part opposite that part having a form conjugate with the tube a tooth designed to function as a clamping element inserted in a corresponding notch provided on said attaching element.

11. The structure for chairs, small armchairs and the like in accordance with claim 10 wherein said tooth has a height increasing from the internal end toward the external end of said insert.

12. The structure for chairs, small armchairs and the like in accordance with claim 8 wherein said tube inserts are arranged in an opposed manner in relation to said baffle and include tie-rods which unite the inserts by mutually tightening said inserts one toward the other.

13. The structure for chairs, small armchairs and the like in accordance with claim 12 wherein said inserts have at the internal end a through passing hole and a threaded hole for the passage and screwing down respectively of said tie-rods.

14. The structure for chairs, small armchairs and the like in accordance with claim 1 wherein said inserts have a seat on the external end thereof for the connection of accessories.

15. The structure for chairs, small armchairs and the like in accordance with claim 1 wherein the bearing body comprises a back provided in a monobloc structure with said seat.

16. The structure for chairs, small armchairs and the like in accordance with claim 2 wherein said tube develops along a direction substantially parallel to the development of a side edge of said seat.

17. The structure for chairs, small armchairs and the like in accordance with claim 3 wherein said tube develops along a direction substantially parallel to the development of a side edge of said seat.

18. The structure for chairs, small armchairs and the like in accordance with claim 4 wherein said tube develops along a direction substantially parallel to the development of a side edge of said seat.

19. The structure for chairs, small armchairs and the like in accordance with claim 5 wherein said tube develops along a direction substantially parallel to the development of a side edge of said seat.

* * * * *